United States Patent [19]

Hellwig

[11] 4,224,553

[45] Sep. 23, 1980

[54] GAS DISCHARGE INDICATOR DEVICE

[75] Inventor: Wolfgang Hellwig, Ulm, Fed. Rep. of Germany

[73] Assignee: Licentia Patent-Verwaltungs-G.m.b.H., Frankfurt am Main, Fed. Rep. of Germany

[21] Appl. No.: 949,553

[22] Filed: Oct. 10, 1978

[30] Foreign Application Priority Data

Oct. 7, 1977 [DE] Fed. Rep. of Germany ..... 2745101

[51] Int. Cl.[2] ..... H01J 61/42

[52] U.S. Cl. ..... 313/489; 313/112

[58] Field of Search ..... 313/489, 112, 113

[56] References Cited

U.S. PATENT DOCUMENTS

| | | | |
|---|---|---|---|
| 2,299,720 | 10/1942 | Holman | 313/489 |
| 2,892,956 | 6/1959 | Vodicka | 313/489 |
| 3,225,241 | 12/1965 | Spencer et al. | 313/113 X |
| 3,748,518 | 7/1973 | Lewis | 313/489 |
| 3,900,758 | 8/1975 | Andoh et al. | 313/485 |
| 3,952,221 | 4/1976 | Kamegaya et al. | 313/188 |

FOREIGN PATENT DOCUMENTS

| | | |
|---|---|---|
| 2253546 | 7/1973 | Fed. Rep. of Germany . |
| 2315230 | 10/1977 | Fed. Rep. of Germany . |
| 1213545 | 11/1970 | United Kingdom . |

*Primary Examiner*—Robert Segal

*Attorney, Agent, or Firm*—Spencer & Kaye

[57] ABSTRACT

A gas discharge indicator device including a discharge chamber provided with an anode and a cathode between which is produced a gas discharge producing UV radiation, the discharge chamber being provided with at least one coating of light emitting material which emits visible light in response to the emitted UV radiation, and a light transmitting panel which delimits the discharge chamber at least on one side, and through which the visible light is observable, is provided with material disposed on at least part of the surfaces delimiting the discharge chamber for reflecting UV radiation in order to increase the proportion of emitted UV radiation conducted onto the layer of light emitting material.

4 Claims, 2 Drawing Figures

GAS DISCHARGE INDICATOR DEVICE

BACKGROUND OF THE INVENTION

The present invention relates to a gas discharge indicator device of the type in which a glow discharge takes place in a discharge chamber between an anode and a cathode so as to produce ultraviolet radiation, and the discharge chamber is provided with at least one luminescent coating which emits visible light in response to the ultraviolet radiation. In such an indicator device this visible light can be observed through a light transmitting pane which closes the discharge chamber at least on one side.

Known gas discharge indicator devices of the above-mentioned type all suffer from the drawback that they produce low light yields which severely limit their usability, particularly when the individual discharge cells are very small as would be the case, for example, if they were to be employed as picture elements in flat video screens. It is also often annoying that, in addition to the visible light emitted by the luminescent coating, the visible component of the glow discharge radiation also reaches the observer and, unless the luminescent material emits the same color as the glow discharge, produces a change in the color of the light emitted by the luminescent material.

SUMMARY OF THE INVENTION

It is therefore an object of the present invention to improve a gas discharge indicator device of the above-mentioned type, particularly with respect to the above-noted undesirable phenomena. Thus specific objects of the invention are to increase the quantity and color purity of the light produced by such devices.

These and other objects are achieved, according to the present invention by making at least part of the surfaces delimiting the discharge chamber capable of reflecting UV radiation so that a larger proportion of the emitted UV radiation is transmitted to the luminescent layer.

By making at least part of the walls delimiting the discharge chamber capable of reflecting UV radiation as described above, it has been found that a significantly greater proportion of the UV radiation produced by the discharge is directed onto the coating of luminescent material so that it will be more intensively excited to emit visible light.

DESCRIPTION OF THE PREFERRED EMBODIMENTS

Figure 1:
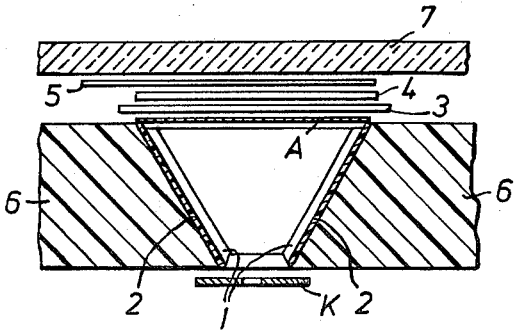
FIGS. 1 and 2 are schematic cross-sectional views of two preferred embodiments of indicator devices according to the invention.

In the cross-sectional view of FIG. 1 there is shown a discharge cell of a gas discharge indicator device having a conical or pyramidal discharge chamber. The gas discharge takes place between a cathode K and an an anode A located at the ends of the discharge chamber. The discharge chamber is delimited laterally by wall elements 6, and toward the observer by a glass plate or sheet 7 which may be tinted with gray or a color. The wall elements are preferably made of an insulating material, such as a ceramic. The UV radiation produced by the discharge reaches a luminescent, or light-emitting, screen 4 interposed between anode A and plate 7 and excites it to emit visible light which an observer can see through the glass plate 7.

According to the invention, the surfaces of the wall elements 6 which laterally delimit the discharge chamber are provided with coatings 1 which reflect UV radiation. A major portion of the UV radiation reflected from coatings 1 also reaches the luminescent screen 4 so that it is excited more intensively.

Such a coating 1 which reflects UV radiation can be constituted, for example, by an $SiO_2$ layer that is vapor-deposited or sputtered on to a thickness proportional to $\lambda/2$, where $\lambda$ is the wavelength of the UV radiation. According to a further feature of the invention, a layer 2 is provided between each coating 1 and the associated wall surface to absorb the visible incandescent light produced during the discharge. The coating 1 is then preferably formed so that it essentially reflects only UV radiation but absorbs or passes the visible incandescent light. Layer 2 can, for example, be of a material presenting an optically black surface.

According to a further feature of preferred embodiments of the invention an optical compensating layer 3 is provided at least at one side of the screen of luminescent material 4. This compensating layer, which in the illustrated embodiment is provided on the gas discharge side of the layer of luminescent material, is designed so as to transmit UV radiation essentially completely, but to reflect visible light as completely as possible. This layer may also be made, for example, of an $SiO_2$ layer of appropriate thickness.

On the observer's side of screen 4 of luminescent material there is advisably provided a further compensating layer 5 constructed to reflect UV radiation and transmit visible light, and disposed to reflect UV radiation passing through screen 4 of luminescent material back into this screen 4 while transmitting the visible light emitted from screen 4 of luminescent material as completely as possible.

Figure 2:
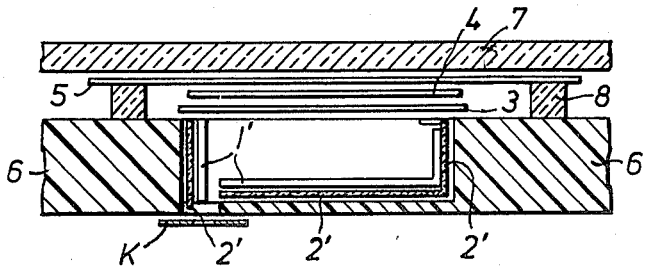

In the embodiment shown in FIG. 2, parts identical to those of FIG. 1 bear the same reference numerals, while functionally similar parts are provided with identical reference numerals to which a prime is affixed. The surfaces of lateral wall portion 6 are here also covered with coatings 1' which reflect UV radiation and coatings 2' which absorb the visible incandescent light. The rear surface of the cell is similarly covered with coatings 1' and 2' likewise, compensating layers 3 and 5 are provided on both sides of the screen 4 of luminescent material with properties as described in connection with FIG. 1.

The thickness of layer 5 depends on the diffraction index $n_7$ of the glass plate 7 and the diffraction index $n_5$ of the layer 5.

If $n_7 > n_5$, the thickness of layer 5 is proportional to $\lambda/2$, where $\lambda$ is again the UV radiation wavelength.

On the other hand if $n_7 < n_5$, the thickness of layer 5 is proportional to $\lambda/4$.

Layer 3 may consist of $SiO_2$. The thickness of this layer depends on the wavelength $\lambda$ of the transmitted UV radiation and on the diffraction index $n_3$ of layer 3.

If $n_3 < 1$, the thickness of the layer is proportional to $\lambda/4$.

If $n_3 > 1$, the thickness of the layer is proportional to $\lambda/2$.

The coating 4 of light-emitting material is embedded in absorbing or reflecting material 8 at its narrow delimiting surfaces.

The absorbing material may be a sealing glass with a light-absorbing component, for instance cobalt oxide.

The reflecting material may be a sealing glass without a light-absorbing component.

Layer 5 may consist of $SiO_2$ with titanium oxide or with tin indium oxide.

The gas discharge chamber could be filled with any conventional gas known for this purpose, one typical example being a mixture consisting of 99% helium and 1% xenon. The luminescent screen 4 could be composed of a luminescent substance currently utilized in color television picture tubes, typical examples being a zinc silicate material which emits in the green region, $\lambda_2O_3$ doped with europium which emits in the red region, and a yttrium silicate doped with cerium which emits in the red region.

It is to be understood that the above description of the present invention is susceptible to various modifications, changes and adaptations, and the same are intended to be comprehended within the meaning and range of equivalents of the appended claims.

What is claimed is:

1. In a gas discharge indicator device including a discharge chamber having two opposed generally parallel sides and provided with an anode and a cathode between which is produced a gas discharge producing UV radiation, the discharge chamber being provided with a coating of light emitting material which emits visible light in response to the emitted UV radiation, and a light transmitting panel which delimits the discharge chamber at least on one side, and through which the visible light is observable, the improvement comprising means disposed on surfaces laterally delimiting said discharge chamber for reflecting UV radiation and absorbing visible light and means extending adjacent said panel and located between said panel and said coating for reflecting UV radiation and transmitting visible light, in order to increase the proportion of emitted UV radiation conducted onto the coating of light emitting material, said coating being located between said means extending adjacent said panel and the interior of said chamber.

2. An arrangement as defined in claim 1 wherein said light transmitting panel is tinted.

3. An arrangement as defined in one of claims 1 or 2 further comprising means at the gas discharge side of said coating of light-emitting material for reflecting visible light and transmitting UV radiation.

4. An arrangement as defined in one of claims 1 or 2 wherein said coating of light-emitting material is embedded in absorbing or reflecting material at its narrow delimiting surfaces.

* * * * *